United States Patent [19]

Brown

[11] Patent Number: 4,987,819

[45] Date of Patent: Jan. 29, 1991

[54] FLAIL SYSTEM FOR A TERRAIN CLEARANCE SYSTEM

[75] Inventor: Stephen Brown, Burwell, Great Britain

[73] Assignee: Aardvark Clear Mine Limited, Aberdeenshire, Scotland

[21] Appl. No.: 422,586

[22] Filed: Oct. 17, 1989

[30] Foreign Application Priority Data

Oct. 18, 1988 [GB] United Kingdom ..... 8824314

[51] Int. Cl.[5] ..... F41H 11/12

[52] U.S. Cl. ..... 89/1.13

[58] Field of Search ..... 89/1.13

[56] References Cited

U.S. PATENT DOCUMENTS

| | | | |
|---|---|---|---|
| 1,035,056 | 8/1912 | Shubert et al. | 89/1.13 |
| 1,263,965 | 4/1918 | Twitchel | 89/1.13 |
| 1,542,963 | 6/1925 | Russell | 89/1.13 |
| 2,489,564 | 11/1949 | DuToit | 89/1.13 |
| 2,496,423 | 2/1950 | Taylor | 89/1.13 |
| 4,590,844 | 5/1986 | Bar-Nefy et al. | 89/1.13 |
| 4,765,221 | 8/1988 | Sombrowski | 89/1.13 |
| 4,909,330 | 3/1990 | Kasher et al. | 89/1.13 |

*Primary Examiner*—David H. Brown

*Attorney, Agent, or Firm*—Ratner & Prestia

[57] ABSTRACT

A Flail System (12) for a terrain clearance vehicle (10) is disclosed which comprises two flail axles (14) which extend laterally in fron of the veicle (10). Each flail axle (14) carries an axially-distributed array of flail chains (20) and has two sets of mounting arms (16, 18) on which the axles (14) are rotatably mounted. The mounting arms (16, 18) also incorporate means (28) to maintain each flail axis (14) at a controllable height above the terrain. The mounting means (16, 18, 22, 24) are arranged such that the flail axles (14) can be held either substantially parallel to the terrain in a terrain clearing configuration. They may also be folded upwardly into an inactive configuration so that the overall width of the vehicle (10) and flail system (12) is substantially less than the overall width of the flail system (12) when in the terrain clearing configuration.

9 Claims, 3 Drawing Sheets

FLAIL SYSTEM FOR A TERRAIN CLEARANCE SYSTEM

This invention relates to terrain clearance systems, and more particularly to terrain clearance systems employing rotating flails.

BACKGROUND OF THE INVENTION

It has been known for many years to employ rotating flails for clearing terrain sown with land mines, as is shown by U.S. Pat. No. 2,496,423. Such known mine clearance systems comprise a single rigid flail axle (or drum) carried on a pair of side arms in front of a propelling vehicle, which is commonly a tank. A number of flail chains are attached to the flail axle at points along the axle, so as to form a flail system in which the flail chains beat the terrain when the flail axle is rotated. As the vehicle moves forward carrying the rotating flail system in front of it, a strip of terrain is more or less cleared of mines due to their being detonated by chain impact. In order to avoid the vehicle passing over uncleared terrain at the margins of the cleared strip, the flail system is necessarily at least as wide as the vehicle, and the flail system is normally wider than the vehicle both to preserve the vehicle and to maximize the area of cleared terrain. The flail-mounting side arms effectively increase the gross width of the terrain clearance system since they must necessarily be located at either end of the flail axle to avoid collision with the flail chains. Thus known flail systems inevitably have an overall width in excess of the overall width of the propelling vehicle.

The flail-mounting side arms are commonly pivoted at their points of attachment to the propelling vehicle such that the flail system can rise or fall as a whole about a pivot axis which is horizontal when the propelling vehicle is upright and which is also at right angles to the straight-ahead direction of vehicle travel. However, even if the side arms are fully raised to lift the flail system clear of the terrain (for example, if the vehicle is crossing mine-free terrain), the known flail systems impose an irreducible transverse clearance requirement in excess of that due to the width of the vehicle alone. This excess width requirement for terrain clearance vehicles when not employed on terrain clearance duties is a disadvantage since, for example, an otherwise suitable vehicle may be prevented from using facilities such as tracks, highways, gates, bridges, garages, and workshops (or else these facilities must provide clearance which is wider than is necessary for the vehicle alone).

It is therefore an object of the invention to provide a terrain clearance system and a flail system therefor in which the above-described disadvantage is obviated or mitigated.

SUMMARY OF THE INVENTION

According to a first aspect of the present invention there is provided a flail system for a terrain clearance system, the flail system comprising at least two flail axles each extending laterally on a respective side of the longitudinal axis of the flail system, each flail axle carrying a respective axially-distributed array of flail chains, mounting means for rotatably mounting each end of each flail axle at a controllable height above terrain, said mounting means being such that the flail axles can be held either substantially parallel to terrain in a terrain-clearing configuration of the flail system or folded upwardly into an inactive configuration of the flail system having an overall width which is substantially less than the overall width of the flail system when in the terrain-clearing configuration.

The mounting means may comprise a respective pair of arms rotatably mounting each flail axle at each end thereof with each pair of arms conjointly pivotable in substantially vertical planes substantially parallel to the longitudinal axis and substantially independently of such pivoting movement of each other pair of arms whereby to raise and lower the respective flail axle substantially without altering the inclination thereof with respect to underlying terrain, said two flail axles each being upwardly foldable by swinging of the respective pair of mounting arms about a respective swing axis substantially parallel to the longitudinal axis.

The mounting means preferably comprises downward projections, which may be skids, to constrain the flail axles to a minimum height above terrain. Typically, the flails have sensors mounted within them which sense the height and the signals emitted from the sensors control the height of the flails above the terrain.

According to a second aspect of the present invention a terrain clearance system comprises a vehicle having a leading end which leads in normal movement of the vehicle during terrain clearing operation, the leading end of the vehicle supporting a flail system according to the first aspect of the present invention and having the longitudinal axis thereof substantially aligned with the direction of normal movement of the vehicle, the terrain clearance system further comprising flail axle driving means, and flail system configuration altering means linking the vehicle and the flail system or comprised within the flail system to act on said mounting means such that the flail system is controllably altered between the terrain-clearing configuration and the inactive configuration in use of the terrain clearance system.

The flail system configuration altering means may comprise one or more linear actuators, which may be hydraulically or pneumatically operated piston/cylinder assemblies.

The vehicle is preferably self-propelled, and the flail axle driving means may comprise either a power take-off from a tractive engine by which the vehicle is self-propelled, or a flail-driving engine separate from the tractive engine.

BRIEF DESCRIPTION OF THE DRAWINGS

Embodiments of the invention will now be described by way of example with reference to the accompanying drawings in which.

DESCRIPTION OF PREFERRED EMBODIMENTS

Figure 1A:
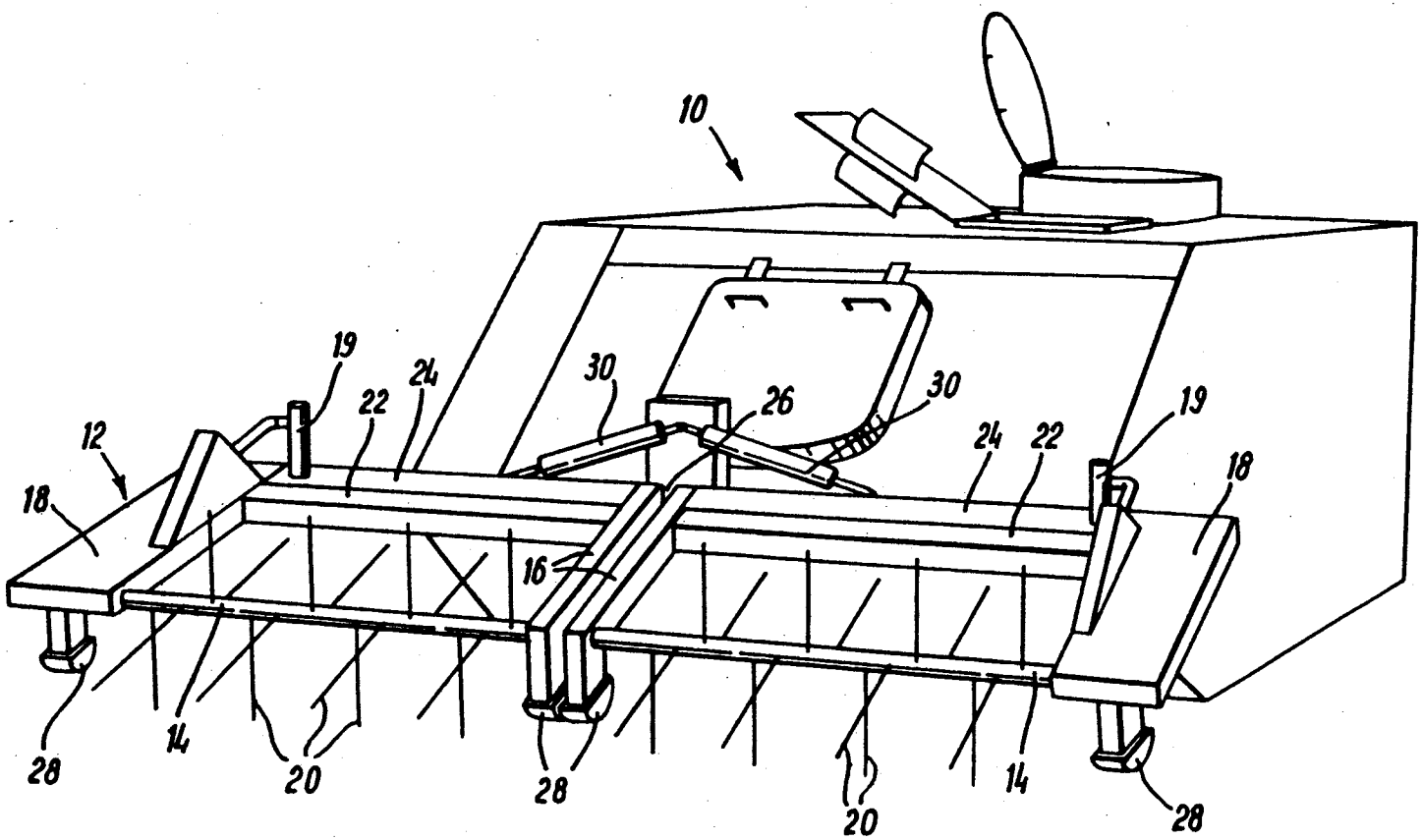
FIG. 1*a* and 1*b* show a first example of a terrain clearance system with a flail system in a first and second terrain clearing configuration respectively; and, FIG. 2 shows a second example of a terrain clearance system with the flail system in an inactive position.
Figure 1B:
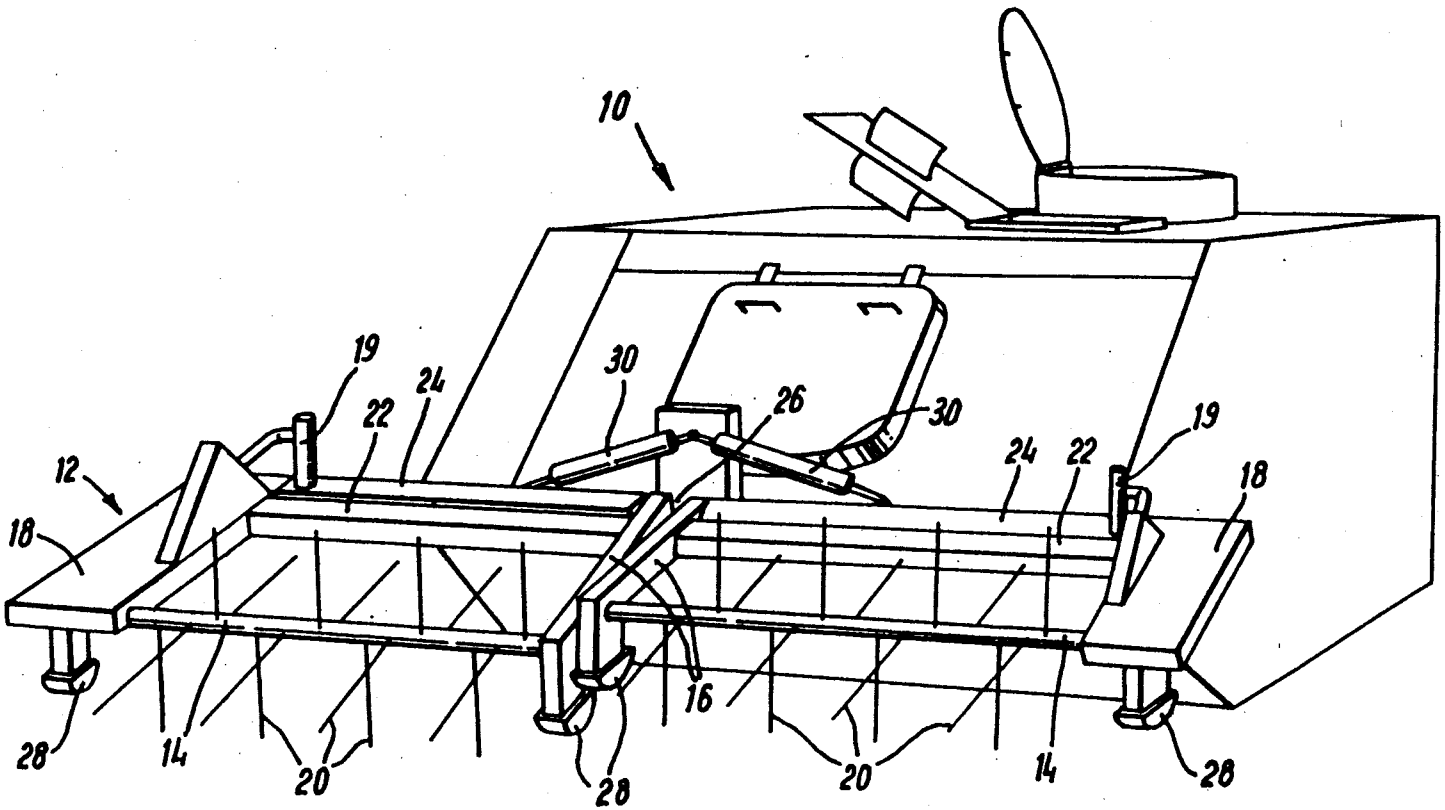

FIGS. 1*a* and 1*b* show a terrain clearance vehicle 10 which is a self-propelled track-laying vehicle suitable for off-highway use. The leading end of the vehicle 10 supports a flail system 12 which is bi-laterally symmetrical about the fore and aft central line of the vehicle 10, i.e. the longitudinal axis of the flail system 12 is generally coincident with the direction of travel of the vehicle 10. At least the leading end of the vehicle 10 is armoured for protection against flying debris.

The flail system 12 comprises two flail axles 14 each rotatably supported at its ends by an inboard arm 16 and an outboard arm 18. Each flail axle 14 carries an axially-distributed and circumferentially-distributed array of flail chains 20 to provide a uniform terrain flailing action as the vehicle 10 progresses with the flail system 12 in action. Each of the outboard arms 18 houses a flail drives mechanism (not visible) to rotate the respective flail axle 14 during flailing operation. The flail drive mechanisms are powered by an engine (not visible) within the vehicle 10, the engine being either the main tractive engine or an auxiliary flail-driving engine.

The pair of arms 16 and 18 for each flail axle 14 are rigidly linked by a respective cross-member 22 to form an approximately "C"-shaped three-sided rectilinear frame (the fourth side of the rectangle being the respective flail axle 14). Thus the flail system 12 can be considered as comprising two flail sub-systems, each of which has some features in common with a conventional single-axle flail. Each of these rotational flail sub-systems is pivotally mounted on a respective one of two spars 24 which extend laterally on either side of a common central suspension point 26 on the longitudinal axis of the flail system 12. The central suspension point 26 is secured to the leading end of the vehicle 10 to carry the flail system 12. The pivotal mounting of each of the arms 16 and 18 on the spars 24 is such as to allow the arms 16 and 18 to rise and fall in respective vertical planes which are substantially parallel to the longitudinal axis of the flail system 12. The arms 16, 18 are raised and lowered by means of the piston assemblies 19 mounted on each spar 24 and which are connected to the arms 18. Within each rotational flail sub-system, the rigid linking provided by the cross-member 22 compels the respective pair of arms 16 and 18 to pivot together. Thus each of the flail axles 14 can independently swing up and down in front of the vehicle 10 without skewing (see FIG. 1*b*), i.e. each flail axle 14 can assume its own height above terrain while remaining substantially horizontal (when the vehicle 10 is upright) and hence generally parallel to level terrain as shown in the FIGS. 1*a* and 1*b*. Such pivoting allows the flail system 12 to follow undulating terrain, "climb" over obstructions, compensate for pitching of the vehicle 10, and resile from exploding land mines.

Each of the arms 16 and 18 in the flail system 12 has a downwardly projecting skid 28 secured to its forward end. Each of the skids 28 has a sensor located within it which sends a signal to a control box (not shown) which controls the actuation of the piston assemblies 19. This height control system ensures that each of the flail axles 14 is normally constrained to maintain a minimum height above terrain being flailed to clear it. Thus the skids 28 obviate or mitigate the hazard of the flail axles 14 coming so close to terrain that the flail chains 20 wrap around the axle 14 instead of whirling freely while being centrifugally extended along approximately radial paths, as shown depicted in FIGS. 1*a* and 1*b*. Chain wrap is a risk when attempting to flail mines in wheel ruts, and the skids 28 are expected to prevent chain wrap in such circumstances.

It will be noted from FIGS. 1*a* and 1*b* that the combined width of the two flail axles 14 is somewhat greater than the width of the vehicle 10 (as is necessary to avoid having the vehicle run over the uncleared margins next to a cleared strip of terrain). The outboard arms 18 (with their internal flail drives) add to the overall width of the flail system 12 which therefore significantly exceeds the width of the vehicle 10. Two arrangements for reducing the overall width of the flail system 12 to less than the width of the vehicle 10 will now be described.

In the first example, see FIGS. 1*a* and 1*b*, both of the spars 24 are individually pivoted on the central suspension point 26 about axes substantially parallel to the longitudinal axis of the flail system 12. This form of spar mounting enables the spars 24 to swing upwards about the central suspension point 216 such that the outboard arms 18 move upwardly and inwardly to come within the width of the vehicle 10. Such swinging movement is controlled by a pair of hydraulic or pneumatic piston and cylinder assemblies 30, or by any other suitable linear or rotary actuator.

Figure 2:
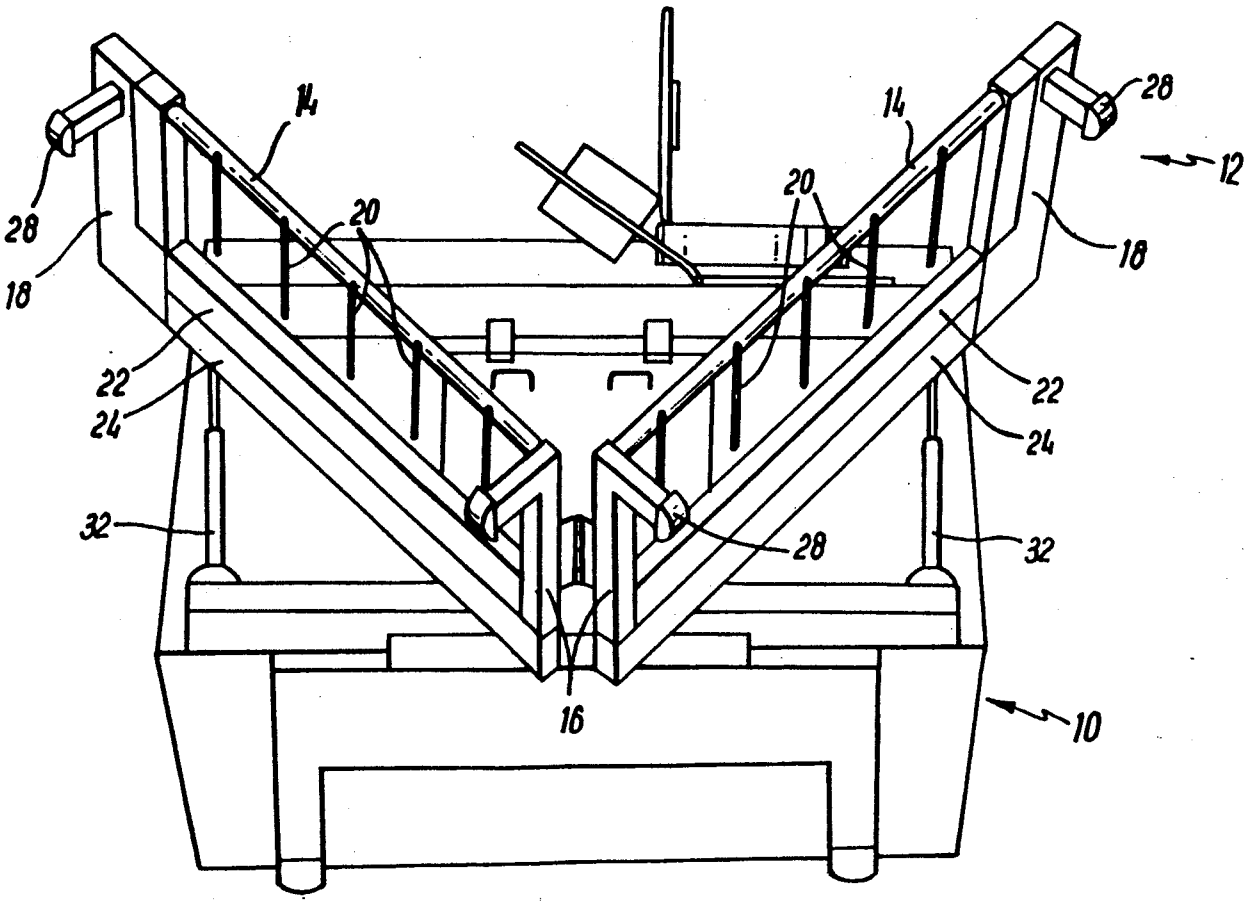

In the second example, shown in FIG. 2, all the individual components are similar and identical components are indicated using the same reference numerals as in FIGS. 1*a* and 1*b*. However, in this example the spars 24 are swung upwards to the position shown in FIG. 2 by means of the pistons 32. As with the first example this causes the outboard arms 18 to move upwardly and inwardly so that they came within the width of the vehicle 10.

Thus the flail system 12 can be altered by a folding operation from the depicted terrain-clearing configuration to an inactive configuration in which the flail axles 14 are swung upwards and inwards towards vertical positions, to occupy less than the width of the vehicle 10 and reduce the vehicle's width clearance requirements to those of the same vehicle devoid of a flail system. Prior art mine clearing vehicles employing flails lack this ability literally to fold the flail system from a deployed position to a retracted position.

As well as being suitable for clearing terrain of land mines, the depicted terrain clearance vehicle could also be employed for clearing terrain of bushes, scrub, undergrowth and the like, and for other duties in which a rotating flail system or its equivalent is or could be utilized.

Modifications and variations of the above-described arrangements can be adopted without departing from the scope of the invention.

I claim:

1. A flail system for a terrain clearing system, the flail system comprising at least two flail axles each extending laterally on a respective side of the longitudinal axis of the flail system, each flail axle carrying a respective axially-distributed array of flail chains, mounting means for rotatably mounting each of each flail axle at a controllable height above terrain, said mounting means being such that the flail axles can be held either substantially parallel to terrain in a terrain-clearing configuration of the flail system or folded upwardly into an inactive configuration of the flail system having an overall width which is substantially less than the overall width of the flail system when in the terrain-clearing configuration.

2. A flail system according to claim 1, wherein the mounting means comprises a respective pair of arms rotatably mounting each flail axle at each end thereof with each pair of arms conjointly pivotable in substantially vertical planes substantially parallel to the longitudinal axis.

3. A flail system according to claim 2, wherein each pair of arms is pivotable substantially independantly of such pivoting movement of each other pair of arms in order to raise and lower the respecting flail axles substantially without altering the inclination thereof, with respect to underlying terrain.

4. A flail system according to claim 1, wherein the at least two flail axles are each upwardly foldable by swinging of the respective pair of mounting arms about a respective swing axis, substantially parallel to the longitudinal axis.

5. A flail system according to claim 1, wherein the mounting means comprises downward projections to constrain the flail axles to a minimum height above terrain.

6. A flail system according to claim 5, wherein the downward projections are skids.

7. A terrain clearance system comprising a vehicle having a leading end which leads in normal movement of the vehicle during terrain clearing operation, the leading end of the vehicle supporting a flail system comprising at least two flail axles each extending laterally on a respective side of the longitudinal axis of the flail system, each flail axle carrying a respective axially-distributed array of flail chains, mounting means for rotatably mounting each end of each flail axle at a controllable height above terrain, said mounting means being such that the flail axles can be held either substantially parallel to terrain in a terrain-clearing configuration of the flail system or folded upwardly into an inactive configuration of the flail system having an overall width which is substantially less than the overall width of the flail system when in the terrain-clearing configuration, and the longitudinal axis substantially aligned with the direction of normal movement of the vehicle, the terrain clearance system further comprising flail system configuration altering means linking the vehicle and the flail system or comprised within the flail system to act on said mounting means such that the flail system is controllably altered between the terrain-clearing configuration and the inactive configuration in use of the terrain clearance system.

8. A terrain clearance system according to claim 7, wherein the flail system configuration altering means comprises one or more linear actuators.

9. A terrain clearance system according to claim 8, wherein the linear actuators are hydraulically or pneumatically operated piston/cylinder assemblies.

* * * * *